US005619869A

United States Patent [19]

Tacy

[11] Patent Number: 5,619,869

[45] Date of Patent: Apr. 15, 1997

[54] WARP KNITTED TEXTILE FABRIC WITH PATTERN OF PLEATED FABRIC SECTIONS

[75] Inventor: Stephen L. Tacy, Greensboro, N.C.

[73] Assignee: Guilford Mills, Inc., Greensboro, N.C.

[21] Appl. No.: 610,608

[22] Filed: Mar. 8, 1996

[51] Int. Cl.[6] ..... D04B 21/00

[52] U.S. Cl. ..... 66/195; 66/196

[58] Field of Search ..... 66/191, 193, 195, 66/196, 197

[56] References Cited

U.S. PATENT DOCUMENTS

| | | | |
|---|---|---|---|
| 3,835,512 | 9/1974 | Piller et al. . | |
| 3,937,041 | 2/1976 | Balcombe . | |
| 4,041,577 | 8/1977 | Matsuda . | |
| 4,399,671 | 8/1983 | Henningsson | 66/196 |
| 4,869,081 | 9/1989 | Groshens . | |
| 4,888,964 | 12/1989 | Klinge . | |
| 4,890,462 | 1/1990 | Essig | 66/197 X |
| 5,065,599 | 11/1991 | Groshens . | |
| 5,074,129 | 12/1991 | Matthew . | |
| 5,172,570 | 12/1992 | Wade et al. | 66/195 |
| 5,297,402 | 3/1994 | Bergmann | 66/195 X |
| 5,379,612 | 1/1995 | Stoll et al. | 66/196 X |

*Primary Examiner*—John J. Calvert
*Attorney, Agent, or Firm*—Shefte, Pinckney & Sawyer

[57] ABSTRACT

A three-bar warp knitted fabric whose technical face has a pattern of coursewise and walewise arrayed pleated sections is produced on a three-bar warp knitting machine by knitting ground yarns on the machine's middle bar to provide a fabric base or ground, knitting pleat-forming yarns on the machine's top bar in extended walewise floats over selected groups of courses at the technical back of the fabric to cause the ground to gather into coursewise pleats at the technical face, and knitting tie-down yarns on the machine's bottom bar in an alternating in-out pattern to appear at the technical face only in selected spaced groups of wales wherein the tie-down yarns also float over the selected groups of courses to define the coursewise pleats into an array of discrete pleated sections.

9 Claims, 1 Drawing Sheet

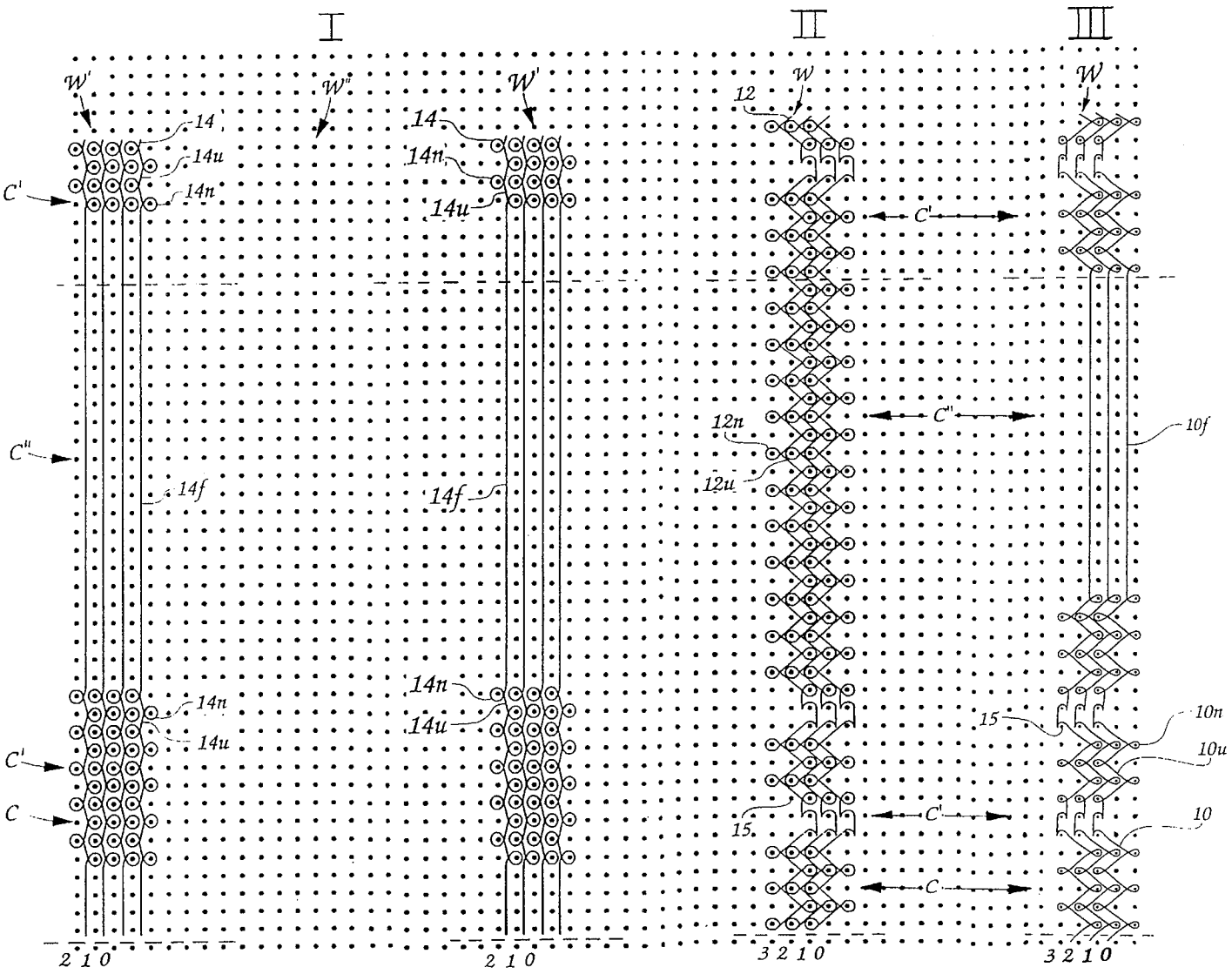
I
II
III
W'
W''
W
14
14n
14u
14f
12
12n
12u
10f
10n
10u
10
15
C'
C''
C
3 2 1 0
2 1 0

WARP KNITTED TEXTILE FABRIC WITH PATTERN OF PLEATED FABRIC SECTIONS

BACKGROUND OF THE INVENTION

The present invention relates generally to warp knitted fabrics and methods of producing such fabrics and, more particularly, to a warp knitted fabric having a pattern of pleated fabric sections arrayed coursewise and walewise over one face of the fabric.

The warp knitting of textile fabrics is a relatively well developed art in which various forms of machines are known to be capable of adjustable set-up to knit various types and sizes of selected yarns in various stitch patterns in order to create wide varieties of differing types of fabrics with diverse surface effects and appearances. One known fabric patterning technique used for creating pleated fabric effects is to warp knit one set of warp yarns in a predetermined stitch pattern forming a ground fabric structure while simultaneously warp knitting a second set of warp yarns to be interknitted with the ground yarns in selected courses while floating across other courses during which the continued knitting of the ground yarns forms the ground fabric structure into a pleat extending coursewise at the locations at which the second set of warp yarns is floated. As will be recognized by persons skilled in the art, the patterning effects available through use of this technique are relatively limited, primarily to the selection of differing sizes and styles of yarns and differing sizes or lengths of floats.

SUMMARY OF THE INVENTION

It is accordingly an object of the present invention to provide a novel warp knitted textile fabric by which more varied forms of pleated patterns can be created. A more particular object is to enable the warp knitting of textile fabrics with patterns of discreet pleated fabric sections arrayed both coursewise and walewise over one face of the fabric.

Briefly summarized, the foregoing objective is accomplished in the present invention by warp knitting a textile fabric in an at least three-bar warp knitted construction utilizing three sets of warp yarns, one set of yarns forming a ground fabric structure and the other two sets of yarns knitted with the ground structure in cooperating float patterns respectively at the opposite faces of the ground structure to create the desired pleated effect. More specifically, the set of ground yarns is knitted in a stitch pattern forming ground stitches in predominantly every wale of predominantly every course. A set of pleat-forming yarns is warp knitted predominantly at the face of the fabric opposite the one face at which the desired pattern of pleated fabric sections is to appear. A particular stitch pattern is selected to form the pleat-forming yarns in knitted stitches interknitted with the ground stitches of the ground yarns in predominantly every wale of selected groups of successive courses longitudinally spaced-apart by intervening groups of successive courses and forming longitudinal walewise floats unknitted with the ground stitches of the ground yarns in predominantly every wale of every intervening course. In this manner, the pleat-forming yarns cause the ground stitches in the intervening groups of courses to form into pleats at the one face of the fabric between the selected groups of courses. The third set of yarns is warp knitted predominantly at the pleated face of the fabric in substantially only selected groups of adjacent wales and in a stitch pattern forming longitudinal walewise floats unknitted with the ground stitches of the ground yarns in the intervening groups of courses to extend across and gather, or "tie-down", the pleats of the ground stitches thereat. In this manner, the tie-down yarns define the pleats of the ground stitches into a pattern of discreet pleated fabric sections arrayed coursewise and walewise over the one face of the fabric.

Those persons skilled in the art will recognize that the fundamental parameters described above for the present invention are susceptible of various embodiments to create diverse pleated effects differing both in visual appearance and in hand or feel of the fabric. All such embodiments are deemed to be within the scope of the present invention. Typically, the selected groups of courses and the intervening groups of courses will each comprise at least approximately ten successive courses. Similarly, the selected groups of wales in which the tie-down yarns appear will typically each comprise at least two adjacent wales and will be spaced from one another by at least approximately ten adjacent wales. For example, in a desirable embodiment, each selected group of courses comprises approximately nineteen successive courses, each intervening group of courses comprises approximately seventeen successive courses, each selected group of wales comprises approximately four adjacent wales, and the selected groups of wales are spaced from one another by approximately 20 adjacent wales.

Various stitch patterns can be utilized for each set of yarns as may be desirable to create differing fabric appearances and effects. For example, in a desirable embodiment, the ground yarns may be warp knitted in a (2-3,1-0)×3; 0-1-0; (2-3,1-0)×2; 0-1,1-0; (2-3,1-0)×11 repeating stitch pattern; the pleat-forming yarns are warp knitted in a (1-0,2,3)×3; 3-2,2-3; (1-0,23)×2; 3-2,2-3; (1-0,2,3)×2; 1-0; (1-1)×17 repeating stitch pattern, and the tie-down yarns are warp knitted in a (1-1)×4; (1-0,1-2)×5; (1-1)×22 repeating stitch pattern.

BRIEF DESCRIPTION OF THE DRAWINGS

FIG. 1 is a diagram showing individually the stitch patterns for the pleat-forming, ground, and tie-down yarns carried out by a warp knitting machine in knitting one preferred embodiment of the present fabric according to the method of the present invention.

DESCRIPTION OF THE PREFERRED EMBODIMENT

As explained more fully herein, the fabric of the present invention is formed on a warp knitting machine which may be of any conventional type of an at least three-bar construction having three or more yarn guide bars and a needle bar, e.g., a conventional tricot warp knitting machine. The construction and operation of such machines are well-known in the knitting art and need not herein be specifically described and illustrated. In the following description, the yarn guide bars of the knitting machine are identified as "top", "middle", and "bottom" guide bars for , reference purposes only and not by way of limitation. As those persons skilled in the art will understand, such terms equally identify knitting machines whose guide bars may be referred to as "front", "middle", and "back" guide bars, which machines of course are not to be excluded from the scope and substance of the present invention. As further used herein, the "bar construction" of a warp knitting machine refers to the number of yarn guide bars of the machine, while the "bar construction" of a warp knitted fabric refers to the number of different sets of warp yarns included in the fabric, all as is conventional terminology in the art.

As is conventional, the needle bar of the warp knitting machine carries a series of aligned knitting needles, while each guide bar of the machine carries a series of guide eyes, the needle and guide bars of the machine preferably having the same gauge, i.e., the same number of needles and guide eyes per inch. According to the embodiment of the present fabric illustrated in FIG. 1, the middle guide bar II is threaded on every guide eye with a set of yarns 12 delivered from a respective warp beam (not shown), suitable for formation of a ground structure for the fabric. The top (or front) yarn guide bar III of the machine is likewise threaded on every guide eye with another set of yarns 10 delivered from another warp beam (also not shown), these yarns being utilized to cause a pleating effect in the ground fabric structure, as herein described. Such yarns will therefore be referred to herein as pleat-forming yarns. The bottom (or back) guide bar I is threaded with a third set of yarns 14 from a third warp beam (also not shown) in a so-called four-in, twenty-out pattern, i.e., the yarns being delivered to four adjacent guides with the next twenty adjacent guide eyes being left empty, and so on in continuing alternation along the length of the guide bar. As described hereinafter, the yarns 14 serve to tie down the pleats formed in the ground fabric structure to achieve a patterning effect, and thus the yarns 14 are referred to herein as tie-down yarns. As will be explained, the threading arrangement of the three guide bars is set up in conjunction with the stitch patterns of the three sets of yarns to achieve the desired pleated patterning effect.

Preferably, all of the yarns are multifilament synthetic yarns, e.g., polyester, but may be of differing denier and filament makeup. For example, in the preferred embodiment depicted in FIG. 1, the ground yarns are a 40 denier, 13 filament semi-dull polyester yarn and the pleat-forming yarns 10 are a slightly larger but similar 45 denier, 20 filament semi-dull polyester, while the tie-down yarns 14 are substantially larger in total denier and denier per filament, e.g., a 70 denier, 17 filament polyester yarn with a relatively bright finish. Of course, those persons skilled in the art will recognize that various other types of yarns may also be employed as necessary or desirable according to the fabric weight, feel, and other characteristics sought to be achieved.

Referring now to the accompanying drawing, one particular embodiment of the present warp knitted fabric of a three-bar construction knitted according to the present invention on a three-bar warp knitting machine, is illustrated. In the accompanying drawings, the stitch construction of the ground, pleat-forming and tie-down yarns as carried out by the respective lateral traversing movements of the guide bars of the knitting machine according to such embodiment of the present fabric and method, are respectively illustrated individually in a traditional dot or point diagram format, wherein the individual points 15 represent the needles of the needle bar of the knitting machine in the formation of several successive fabrics courses C across several successive fabric wales W. According to this embodiment, the middle guide bar of the machine manipulates the ground yarns 12 to traverse laterally back and forth relative to the needles 15 of the needle bar of the machine to stitch the ground yarns 12 in a repeating (2-3,1-0)×3; 0-1,1-0; (2-3,1-0)×2; 0-1,1-0; (2-3,1-0)×11 stitch pattern (diagrammatically indicated at II of FIG. 1) as the ground yarns 10 are fed progressively from their respective warp beam. Simultaneously, the top (front) guide bar of the knitting machine manipulates the pleat-forming yarns 10 as they are fed from their respective warp beam to traverse relative to the needles 15 to alternately stitch and float the pleat-forming yarns 10 in a repeating (1-0,2,3)×3; 3-2,2-3; (1-0,2,3)×2; 3-2,2-3; (1-0,2,3)×2; 1-0; (1-1)×17 stitch pattern (diagrammatically indicated at III of FIG. 1). At the same time, the bottom (back) guide bar of the machine manipulates the tie-down yarns 14 as they are fed from their respective warp beam to traverse relative to the needles 15 to alternately stitch and float the tie-down yarns 14 in a repeating (1-1)×4; (1-0,1,2)×5; (1-1)×22 stitch pattern on spaced groups of four needles each (but not the intervening needles) in the same four-in, twenty-out alternation as the threading of the tie-down yarns on the bottom guide bar, as indicated at I of FIG. 1.

As will thus be understood, the ground yarns 12 are interknitted with one another in the described stitch construction with each ground yarn 12 being formed from one fabric course C to the next fabric course C in a series of needle loops $\mathbf{12}_n$ and in connecting underlaps $\mathbf{12}_u$ extending between the successive needle loops $\mathbf{12}_n$, whereby according to the stitch pattern and the threading pattern of the ground yarns 12, the needle loops $\mathbf{12}_n$ appear in substantially every wale W of every course C in the fabric. The pleat-forming yarns 10 are interknitted with one another and with the ground yarns 12 in substantially every wale W in selected groups of courses C', each group spanning a total of nineteen successive courses and separated from adjacent groups of courses C' by seventeen successive intervening courses C". Within the selected courses C', each pleat-forming yarn 10 is formed in needle loops $\mathbf{10}_n$ interknitted in plated relationship with the needle lops $\mathbf{12}_n$ of the ground yarn 12 in substantially every wale, and in connecting underlaps $\mathbf{10}_u$ extending between the successive needle loops $\mathbf{10}_n$. However, the pleat-forming yarns 10 are not interknitted with the ground yarns in intervening courses C" but rather form extended walewise floats $\mathbf{10}_f$ across each such group of seventeen courses C" at the technical back of the fabric. The tie-down yarns 14 are interknitted with one another and with the ground yarns 12 and the pleat-forming yarns 10 only in groups of four wales W' spaced-apart by intervening groups of twenty wales W" corresponding to the threading pattern of the yarns 14, the tie-down yarns 14 being absent from the intervening wales W" due to the four-in, twenty-out threading pattern Within the wales W', each tie-down yarn 14 is formed in needle loops $\mathbf{14}_n$ interknitted in plated relationship with the needle loops $\mathbf{10}_n$, $\mathbf{12}_n$ of the yarns 10,12 and in connecting underlaps $\mathbf{14}_u$ across the majority of the courses C', but the tie-down yarns 14 are not interknitted with the yarns 10,12 in the intervening courses C" and in the adjacentmost four courses C' preceding and succeeding each group of intervening courses C" so as to form extended walewise floats $\mathbf{14}_f$ thereacross at the technical face of the fabric.

As will thus be understood, the ground yarns 12 form a base or substrate to the fabric essentially between the pleat-forming yarns 10 at the technical back of the fabric and the tie-down yarns 14 at the technical face of the fabric. Because the floats $\mathbf{10}_f$ of the pleat-forming yarns are not knitted in the courses C", the floats $\mathbf{10}_f$ have a shorter walewise length than the corresponding ground fabric structure of the ground yarns 12 across such courses C", whereby the floats $\mathbf{10}_f$ cause the ground fabric to gather between the groups of courses C' into pleats projecting from the technical face of the fabric and extending coursewise across essentially the entire width of the fabric. Since the tie-down yarns 14 are knitted with the ground yarns 12 and the pleat-forming yarns 10 only in the courses C', the tie-down yarns do not interfere with the formation of the coursewise pleats, except that the non-knitted floats $14_f$ of the tie down yarns 14 across the pleated courses C" necessarily have a shorter walewise length than the pleated courses C" and thereby tend to flatten the gathered fabric pleats at the spaced locations of the wales W', causing the coursewise pleats to assume the appearance of plural discrete pleated fabric sections arrayed over the technical face of the fabric in coursewise and walewise rows of spaced discrete pleats.

Of course, those persons skilled in the art will readily recognize and understand that many variations of the basic pleated effect described above may be achieved by varying not only the yarns themselves but also varying their stitch and threading patterns. For example, by increasing or decreasing the float lengths of the floats both of the pleat-forming and tie-down yarns 10,14, and by changing the number and/or frequency of the threading of the tie-down yarns 14, the size and spacing of the pleated sections can be selectively adjusted to create quite diverse visual effects. Selective changes in the size and types of yarn and in the stitch patterns of their knitted regions provide further possibilities for creating varied effects. These and other variations of the specific embodiment described herein are considered to be within the conceptual scope and substance of the present invention.

It will therefore be readily understood by those persons skilled in the art that the present invention is susceptible of broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

What is claimed is:

1. A textile fabric of an at least three-bar warp knitted construction characterized by a pattern of pleated fabric sections at one face of the fabric, the fabric comprising a plurality of yarns interknitted with one another in stitches arranged in longitudinally extending fabric wales and transversely extending fabric courses, the yarns comprising a set of ground yarns warp knitted in a stitch pattern forming ground stitches in predominantly every wale of predominantly every course, a set of pleat-forming yarns warp knitted predominantly at the face of the fabric opposite the one face in a stitch pattern forming knitted stitches interknitted with the ground stitches of the ground yarns in predominantly every wale of selected groups of successive courses longitudinally spaced-apart by intervening groups of successive courses and forming longitudinal walewise floats unknitted with the ground stitches of the ground yarns in predominantly every wale of every intervening course for causing the ground stitches in the intervening groups of courses to form into pleats at the one face of the fabric between the selected groups of courses, and a set of tie-down yarns warp knitted predominantly at the one face of the fabric in substantially only selected spaced-apart groups of adjacent wales and in a stitch pattern forming longitudinal walewise floats unknitted with the ground stitches of the ground yarns in the intervening groups of courses to extend across and gather the pleats of the ground stitches thereat, thereby defining the pleats of the ground stitches into a pattern of discrete pleated fabric sections arrayed coursewise and walewise over the one face of the fabric.

2. A textile fabric having a pattern of pleated fabric sections according to claim 1, wherein each of the selected group of courses comprises at least approximately ten successive courses and each of the intervening group of courses comprises at least approximately ten successive courses.

3. A textile fabric having a pattern of pleated fabric sections according to claim 1, wherein the selected groups of wales are spaced from one another by at least approximately ten adjacent wales and each selected group of wales comprises at least two adjacent wales.

4. A textile fabric having a pattern of pleated fabric sections according to claim 2, wherein the selected groups of wales are spaced from one another by at least approximately ten adjacent wales and each selected group of wales comprises at least two adjacent wales.

5. A textile fabric having a pattern of pleated fabric sections according to claim 4, wherein each selected group of courses comprises approximately nineteen successive courses, each intervening group of courses comprises approximately seventeen successive courses, each selected group of wales comprises approximately four adjacent wales, and the selected groups of wales are spaced from one another by approximately twenty adjacent wales.

6. A textile fabric having a pattern of pleated fabric sections according to claim 5, wherein the tie-down yarns are warp knitted in a (1-1)×4; (1-0,1-2)×5; (1-1)×22 repeating stitch pattern.

7. A textile fabric having a pattern of pleated fabric sections according to claim 6, wherein the pleat-forming yarns are warp knitted in a (1-0,2-3)×3; 3-2,2-3; (1-0,2-3)×2; 3-2,2-3; (1-0,2-3)×2;1-0; (1-1)×17 repeating stitch pattern.

8. A textile fabric having a pattern of pleated fabric sections according to claim 7, wherein the ground yarns are warp knitted in a (2-3,1-0)×3; 0-1,1-0; (2-3,1-0)×2; 0-1,1-0; (2-3,1-0)×11 repeating stitch pattern.

9. A textile fabric having a pattern of pleated fabric sections according to claim 1, wherein the tie-down yarns are warp knitted in a (1-1)×4; (1-0,1-2)×5; (1-1)×22 repeating stitch pattern and are threaded in an alternating pattern of four threaded wales and twenty unthreaded wales, the pleat-forming yarns are warp knitted in a (1-0,2-3)×3; 3-2, 2-3; (1-0,2-3)×2; 3-2,2-3; (1-0,2-3)×2; 1-0; (1-1)×17 repeating stitch pattern, and the ground yarns are warp knitted in a (2-3,1-0)×3; 0-1,1-0; (2-3,1-0)×2; 0-1,1-0; (2-3,1-0)×11 repeating stitch pattern.

* * * * *

UNITED STATES PATENT AND TRADEMARK OFFICE

CERTIFICATE OF CORRECTION

PATENT NO. : 5,619,869

DATED : April 15, 1997

INVENTOR(S) : Stephen L. Tacy

It is certified that error appears in the above-identified patent and that said Letters Patent is hereby corrected as shown below:

Column 2, line 29, delete "0-1-0;" and insert -- 0-1, 1-0; --

Column 2, line 31, delete "(1-0, 2, 3)x 3;" and insert -- (1-0, 2-3)x3; --

Column 2, line 32, delete "(1-0, 23)x2;" and insert -- (1-0, 2-3)x2; --

Column 2, line 32, delete "(1-0, 2,3)x2;" and insert -- (1-0, 2-3)x2; --

Column 2, line 58, delete "for, reference" and insert --for reference --

Column 4, line 2, delete "(1-0,2,3)x3;" and insert -- (1-0,2-3)x3; --

Column 4, line 3, each occurrence, delete "(1-0, 2,3)x2;" and insert --(1-0, 2-3)x2; --

Column 4, line 9, delete "(1-0,1,2)x5;" and insert -- (1-0, 1-2)x5; --

Column 4, line 30, delete "lops" and insert -- loops --

Column 4, line 43, delete "pattern" and insert -- pattern. --

UNITED STATES PATENT AND TRADEMARK OFFICE

CERTIFICATE OF CORRECTION

PATENT NO. : 5,619,869
DATED : April 15, 1997
INVENTOR(S) : Stephen L. Tacy

It is certified that error appears in the above-identified patent and that said Letters Patent is hereby corrected as shown below:

Column 3, line 56 delete "fabrics" and insert --fabric--.

Signed and Sealed this

First Day of December, 1998

*Attest:*

*Attesting Officer*

Bruce Lehman

BRUCE LEHMAN

*Commissioner of Patents and Trademarks*